United States Patent [19]

Grudzien, Jr. et al.

[11] Patent Number: 4,467,155

[45] Date of Patent: Aug. 21, 1984

[54] ELECTRICAL SWITCH APPARATUS

[75] Inventors: Christopher P. Grudzien, Jr., Prospect; Leonard P. DelVecchio, Jr., Trumbull, both of Conn.

[73] Assignee: Dresser Industries, Inc., Dallas, Tex.

[21] Appl. No.: 375,618

[22] Filed: May 6, 1982

[51] Int. Cl.[3] ..... H01H 35/24

[52] U.S. Cl. ..... 200/81 R; 200/81.4; 200/82 C; 200/835

[58] Field of Search ..... 200/5 R, 81 R, 81.4, 200/83 R, 83 P, 835, 835 A, 83 W, 83 B, 153 T, 67 DB, 81.9 R

[56] References Cited

U.S. PATENT DOCUMENTS

| | | | |
|---|---|---|---|
| 2,536,735 | 1/1951 | Gardiner et al. | 200/81.4 |
| 2,950,367 | 8/1960 | McCathron | 200/80 R |
| 3,786,212 | 1/1974 | Weber | 200/83 R |
| 3,911,238 | 10/1975 | Otto et al. | 200/83 S |

FOREIGN PATENT DOCUMENTS

| | | | |
|---|---|---|---|
| 1143894 | 2/1963 | Fed. Rep. of Germany | 200/83 P |

*Primary Examiner*—J. R. Scott

*Attorney, Agent, or Firm*—Daniel Rubin

[57] ABSTRACT

Input force transmitted from a monitored process variable is applied against a displaceable double beam mechanism being opposed by a dual spring bias presettable individually to the separate set points of the switch. Comprising the double beam mechanism is an equalizer beam underlying a pair of scissor beams such that displacement force incurred by the equalizer beam is conducted through the scissor beams and supported push rods to operate the switch actuators. In a hi/lo set point embodiment two switches are separately actuated in a predetermined sequence while in a deadband embodiment a single switch is independently settable for make and break.

10 Claims, 10 Drawing Figures

ELECTRICAL SWITCH APPARATUS

TECHNICAL FIELD

The field of art to which the invention pertains comprises the art of electricity, circuit makers and breakers.

BACKGROUND OF THE INVENTION

Electrical switching apparatus responsive to condition changes in process variables such as pressure or temperature are widely known and are available from a variety of commercial sources. Exemplifying dual function type switch apparatus in the prior art are the disclosures of U.S. Pat. Nos. 3,911,238; 3,786,212; and 2,950,367.

Since such switches are accuracy dependent while sold in price conscious competition, the manufacturers thereof strive to both improve accuracy and reduce costs in order to exploit the advantages those features can afford in the marketing of such switches. A problem encountered with prior art type constructions has been undesirable shifting of the switch set points caused by adverse effects such as material relaxation, thermoelastic effects, etc. Despite recognition of the problem, a ready and economical solution has not heretofore been known.

SUMMARY OF THE INVENTION

This invention relates to electrical switching apparatus. More specifically, the invention relates to an operating mechanism for electrical switches responsive to changes in a measured process variable such as pressure, temperature, differential pressure, level, etc. and able to afford increased accuracy without penalty of increased cost in reducing, if not eliminating, the aforementioned problem of the prior art devices.

The foregoing is achieved in accordance with the invention utilizing a double beam displacement mechanism that includes an equalizer beam receiving the changing input force of the process variable and opposed by parallel biasing springs preset to the desired set points of the switch. Overlying the equalizer beam to be displaced thereby are a pair of scissor beams which on overcoming the opposing spring forces transmit their displacements via parallel push rods to the actuator element of the switch. Not only does this arrangement substantially if not completely overcome the adverse effects of set point shift attributed to the prior art devices supra, but the displacement motion of the scissor beams also provides a controlled vertical guidance to the opposing springs while concomitantly displacing the push rods in order to retain prolonged accuracy of the switch settings.

It is therefore an object of the invention to provide novel electrical switching apparatus for energizing and deenergizing process control circuits in response to changes in a process variable being controlled.

It is a further object of the invention to effect the foregoing object in a manner affording increased longevity during which accuracy of set point operation can be maintained without cost penalty in the manufacture of such switches as compared to such similar purpose switches of the prior art.

DETAILED DESCRIPTION OF THE PREFERRED EMBODIMENT

Figure 2:
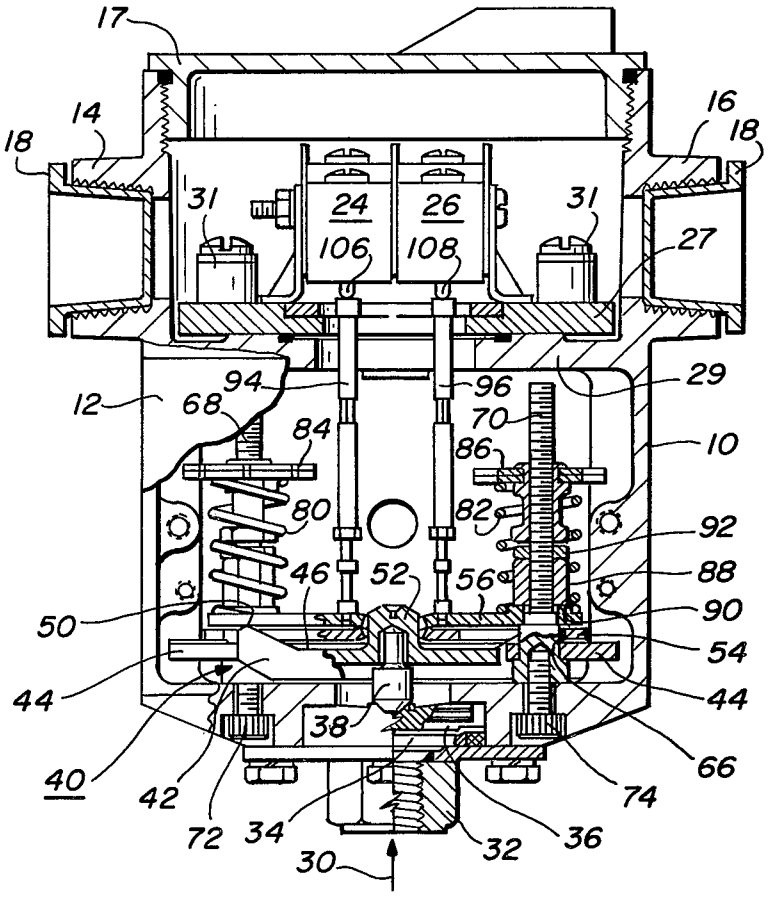
FIG. 2 is a front sectional view similar to FIG. 1.
Figure 1:
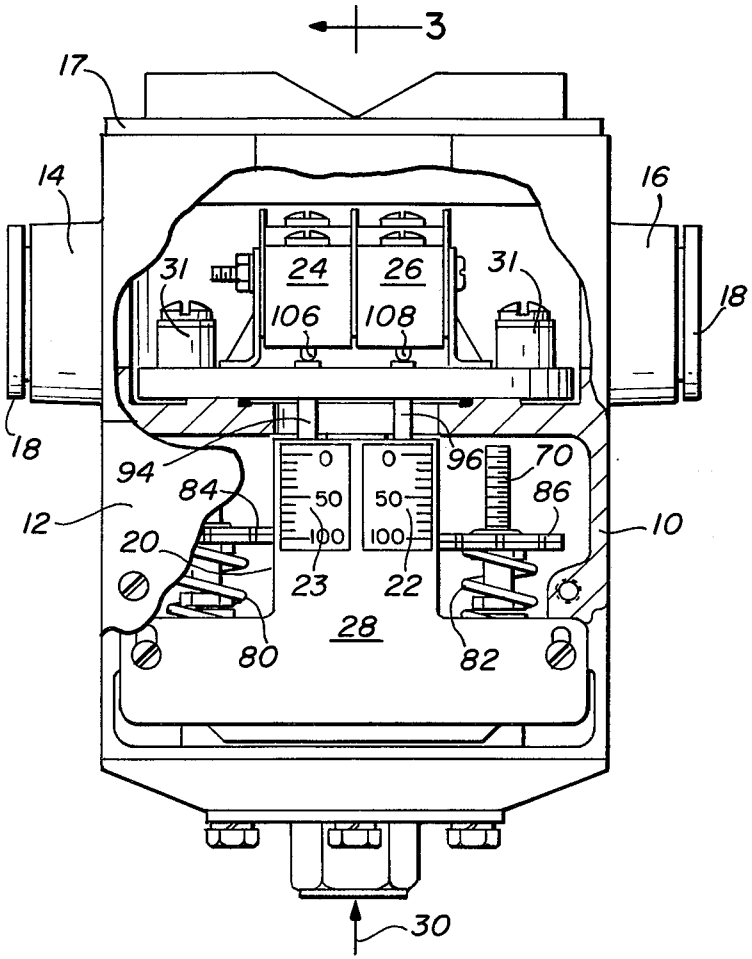
FIG. 1 is a front view partially broken away of a switch apparatus in accordance with the invention for a hi/lo set point embodiment.
Figure 3:
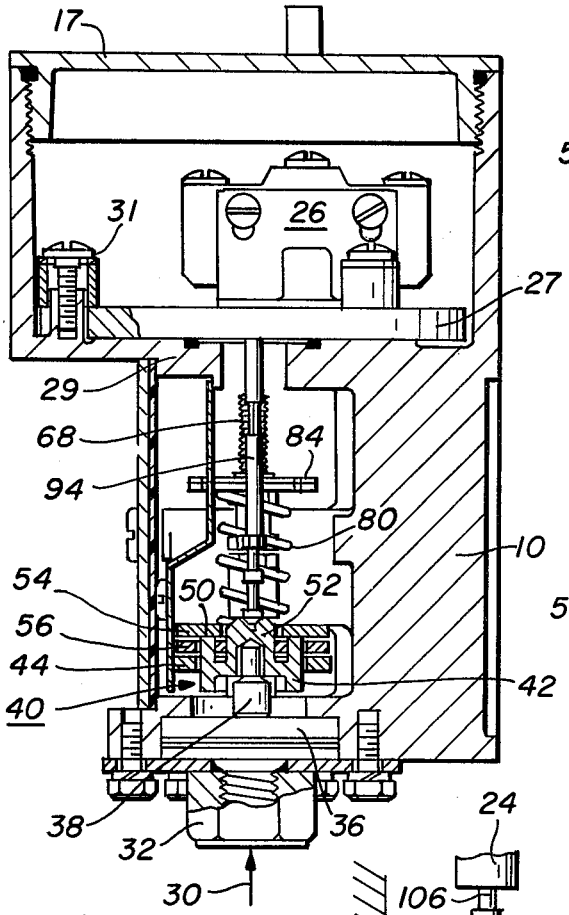
FIG. 3 is a sectional view taken substantially along the lines 3—3 of FIG. 2.

Referring to FIGS. 1–5 of the drawings, the hi/lo set point embodiment of the invention conforms to NEMA 4 and is comprised of a housing 10 supporting a front cover plate 12 and including threaded plugs 14 and 16 used to install the electrical feed. A removable top cover 17 provides access to the switch connection while enclosure caps 18 are used to protect the plugs during shipment. Secured on housing 10 is a scale plate 28 containing scales 20 and 22 having pressure graduations 23 for establishing the set point operation of electrical switches 24 and 26 as will be described. Bolts 31 secure isolation switch plate 27 onto housing wall 29.

Assuming that switches 24 and 26 are to be operated in response to pressure changes from a process variable being monitored, force of the pressure change represented by arrow 30 is supplied via suitable conduit (not shown) connected to nut 32 to communicate inward of a chamber 34. The chamber is sealed by a displaceable diaphragm assembly 36 supporting an engaged vertical actuator pin 38 on its top side and to which the displacement force is communicated. Receiving the distal end of actuator pin 38 and to which in turn the displacement force is further communicated is a displaceable double beam mechanism designated 40, supporting vertical push rods 94 and 96.

Figure 5:
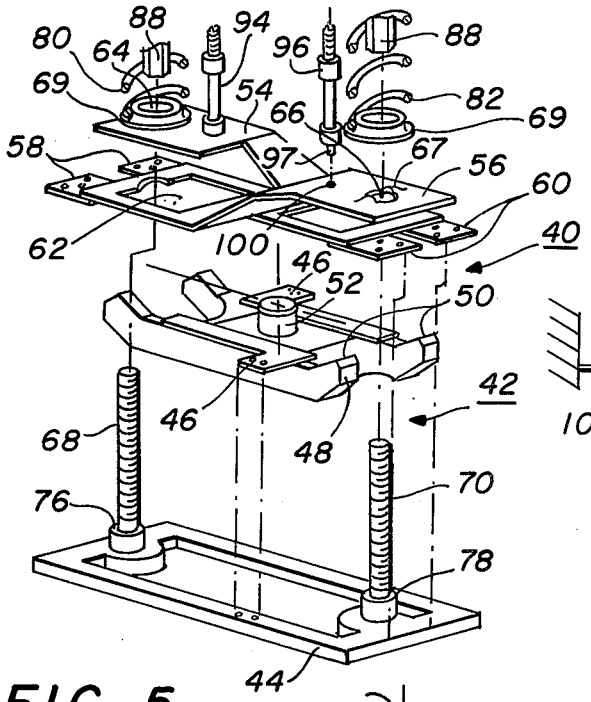
FIG. 5 is a fragmentary explosion view of the components of the double beam mechanism.

Comprising double beam mechanism 40 is an equalizer beam 42 mounted on base plate 44 via flexures 46 which restricts movement of the beam mechanism to restrict movement thereof in a horizontal direction. Equalizer beam 42, as best seen in FIG. 5, is comprised of a sled-like configuration with four upwardly extending runner arms 48 each terminating at an upwardmost crest 50. All crests 50 terminate in a common horizontal plane while a centrally raised hollow cap or boss 52 inwardly receives the distal end of actuator pin 38 likewise terminating at the common plane supra. Superposed overlying the equalizer beam for engagement by crests 50 are a pair of scissor beams 54 and 56 also mounted on base plate 44 via flexures 58 and 60. Each of the scissor beams includes a central aperture 62 to enable straddling of equalizer beam cap 52 while at opposite ends respectively contain apertures 64 and 66. On the beam surface contiguous to the apertures are a pair of oppositely located coined bosses 65 and 67, respectively. Secured to the beam about the bosses is an eyelet 69.

Extending upward from interior of the housing through scissor beam apertures 64 and 66 are studs 68 and 70 secured to the housing via bolts 72 and 74. Each stud is stepped near its lower end to define a first shoulder 76 (FIG. 4) for supporting the base plate 44 and a second shoulder 78 defining the lower stop position of the scissor beam thereon. Also supported on studs 68 and 70 for opposing upward movement of the scissor beams are compressed coil springs 80 and 82 seated about eyelet 69 (FIG. 5) and adapted to apply a preset force via adjuster nuts 84 and 86. Being seated top and bottom between eyelets 71 and 69, respectively, the spring and the loading imposed thereby are maintained in a controlled vertical alignment. In a preferred embodiment, each of the springs are of a metal composition having high strength and superior elastic properties and marketed under the trademark Cryotech. A nut 88 on each of the studs includes a radial underface 90 positioned to define an upward limit for movement of the scissor beam thereat while a jam nut 92 secures the position of stop nut 88.

Figure 4:
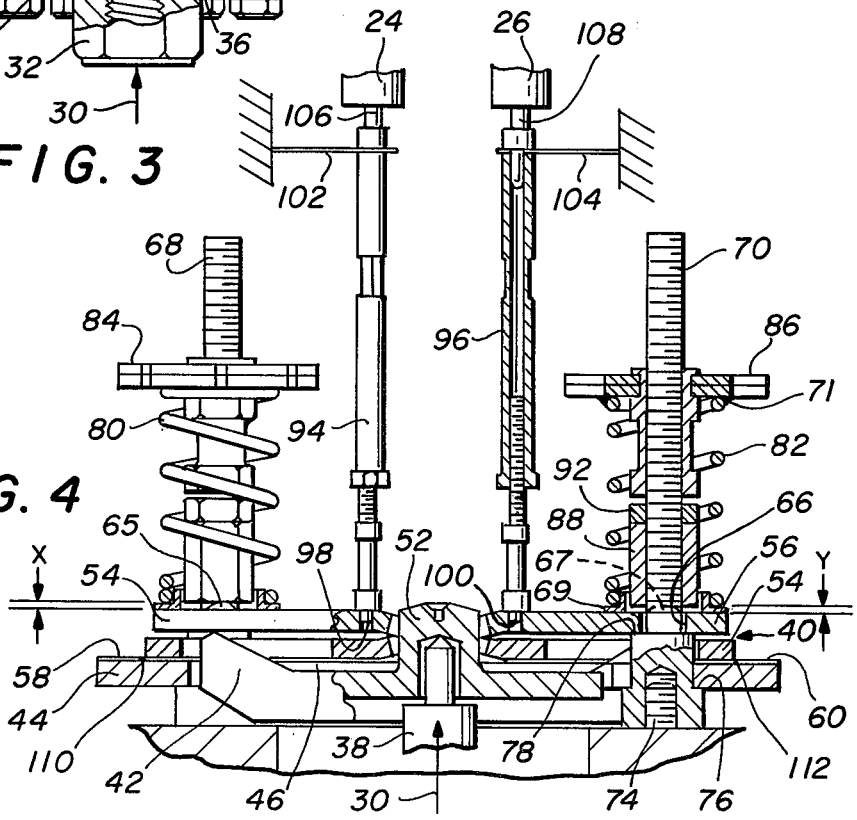
FIG. 4 is a fragmentary enlargement of FIG. 2.

After overcoming the applied force of springs 80 and 82, displacement of the individual scissor beams is transmitted upward to actuate switches 24 and 26 via vertical push rods 94 and 96. The lower end of each push rod includes a reduced size nipple 97 for seated receipt in scissor beam bores 98 and 100, while vertical movement thereof is guided by flexures 102 and 104, respectively. The upper ends of the push rods, as best seen in FIG. 4, are engaged with switch arms 106 and 108 to operably close or open the normally open or normally closed switch contacts at the predetermined setting thereof for the process variable.

In operation of the hi/lo set point embodiment, adjusting nuts 84 and 86 are threadedly moved individually up and down on studs 68 and 70 until the top face thereof is opposite graduations 23 on scales 20 and 22 corresponding to the different set points at which electrical switches 24 and 26 are intended to operate respectively. Input pressure 30 received in chamber 34 acts against flexible diaphragm 36 which in turn applies the force of received pressure against actuator pin 38 in correlation to the magnitude of the pressure being received. The force of actuator pin 38 is conducted through cap 52 of equalizer beam 42 which in turn distributes the input force equally among the coplanar crests 50 constituting reaction points engaging the underside of the scissor beams on either side of the studs 68 and 70. After overcoming the downward force of springs 80 and 82, upward displacement of the equalizer beam produces upward movement of the individual scissor beams. On being displaced, the scissor beams pivot independently about end points 110 and 112 through a limited vertical travel defined between the top surface of bosses 65 or 67 until engaging an upper stop constituted by the underside 90 of the associated stop nut 88. In the course of such displacement, the beams 54 and 56 will incur a maximum travel distance defined by dimensions X and Y, respectively. (FIG. 4).

Figure 6A:
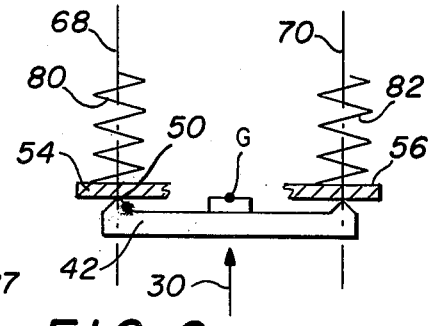
FIGS. 6(*a*) and 6(*b*) are schematic representations of the beam reactions.
Figure 6B:
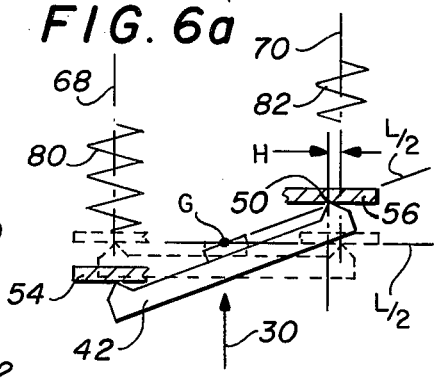

As shown schematically in FIG. 6(*a*), upward movement of the scissor beams are continuously opposed by the springs 80 and 82 applying a downward force to the top surface thereof and to the lower stops 76 and 78, respectively. The degree of force imposed by the springs are dependent on both the spring rate of the selected spring and the extent of compression effected by adjusting nuts 84 and 86. When the force imposed by pressure 30 overcomes the downward spring force, equalizer beam 42 begins to rotate about point G as shown in FIG. 6(*b*). In the course of such rotation, crest 50 slides along the underside of scissor beams 54 and 56 while incurring a horizontal displacement "H" from the axis of stud 70.

Figure 7:
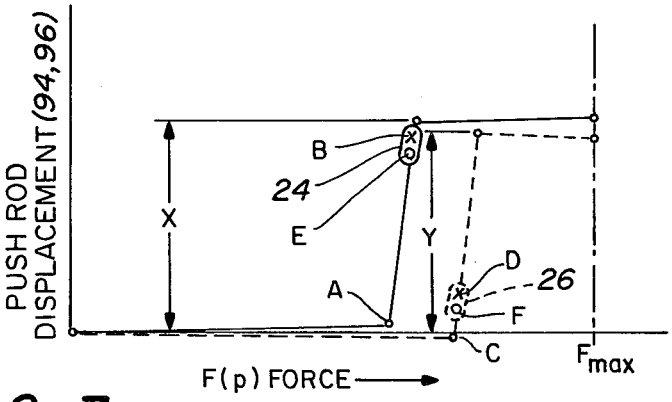
FIG. 7 is a force-displacement diagram.

The foregoing can be further understood by referring to FIG. 7. As there shown, spring 82 is assumed to be applying a downward force against scissor beam 56 greater than the downward force being imposed by spring 80 against beam 54. On the force 30 produced by the input variable increasing to point A, the force at the equalizer beam crests 50 under scissor beam 54 equals the bias force of spring 80. Further increase of force 30 causes scissor beam 54 to begin lift off of lower stop 76 until the force increase caused scissor beam 54 to move upward displacing push rod 94 toward point B at which switch 24 activates. Increasing the input force 30 greater than B causes bosses 65 on scissor beam 54 to engage the upper stop 90 on the underside of nut 88. Holding the force level maintains switch 24 in the activated state and switch 26 in the deactivated state. Still further increases in force 30 increases the input force to point C to enable the force of the equalizer beam under scissor beam 56 to equal the downward force of bias spring 82 and from which the upward displacement of scissor beam 56 can begin from its lower stop 78. Thereafter, increasing the force 30 to point D causes switch 26 to activate through push rod 96 while switch 24 remains activated. A reduction in force 30 first breaks switch 26 at point F followed by breaking of switch 24 at point E.

Figure 8:
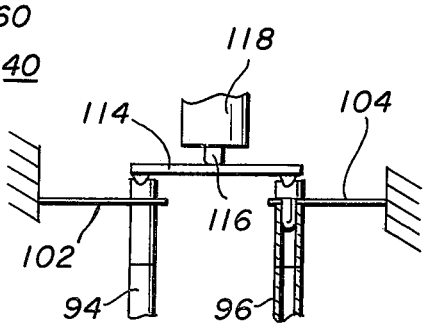
FIG. 8 is a fragmentary view illustrating a modification of FIG. 2 for a deadband embodiment of the invention.
Figure 9:
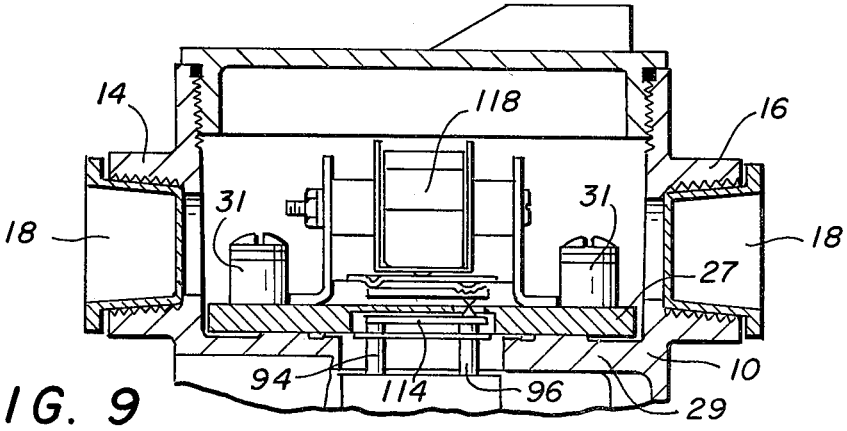
FIG. 9 is a fragmentary modification of FIG. 2 corresponding to the embodiment of FIG. 8.

Referring now to FIGS. 8 and 9, the embodiment thereof conforming to NEMA 4 provides for adjustable deadband used for example where the make and break of the switch elements are to be independently settable to a process variable input range as might be incurred with a compressor or pump controller. In most respects this embodiment is structurally similar to the preceding embodiment including the transformation of input force 30 via the push rods 94 and 96. Unlike the previous embodiment, the displacement here is transmitted from the push rods to a straddle beam 114 supported on single pole double throw electrical switch 118 for actuating the contact arm 116 thereof. Straddle beam 114 actuates switch 118 such that contact closure and opening are independently adjustable similarly determined by the vertical position settings of adjuster nuts 84 and 86.

By the above description there is disclosed a novel switch apparatus able by virtue of thermoelastic properties and expansion coefficients matched with the stop studs to effectively maintain set point accuracy of the switching element that is adjustably preset to meet the requirements of the application for which they are utilized. Thus, even should the equalizer beam incur change in stiffness or creep or incur rocking as a result of temperature or load changes, the set point is not adversely affected. By use of a double beam mechanism comprised of an equalizer beam and a pair of scissor beams cooperating to effect displacement in opposition to adjustably preset spring forces, the device effects such results in an economic manner so as to not economically penalize the advantages which those features afford.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed or defined as follows:

1. Electrical switch apparatus for process control comprising in combination:

a. a housing;

b. at least one electrical switch supported in said housing adapted for connection to an electric circuit associated with a process to be controlled for energizing and deenergizing the circuit at predetermined values of a process variable;

c. double beam means in said housing and displaceable for actuating said at least one electrical switch between the make and break positions of the switch contacts;

d. an inlet in said housing to receive an input force corresponding to ongoing values of the process variable;

e. force applicator means supported in said housing between said inlet and said double beam means for imposing the received input force against said double beam means to urge displacement thereof toward actuating said at least one electrical switch;

f. biasing means operative to apply a force against said double beam means opposing displacement of said double beam means by said force applicator means; and g. adjustment means for presettably adjusting the opposing force of said biasing means to preset set point operation of said at least one electrical switch by said double beam means.

2. Electrical switch apparatus according to claim 1 in which said at least one electrical switch comprises a single electrical switch, and said adjustment means is presettable for adjustable deadband operation of said electrical switch.

3. Electrical switch apparatus according to claim 1 in which said at least one electrical switch is comprised of at least two electrical switches, and said adjustment means is presettable for hi/lo operation of said electrical switches.

4. Electrical switch apparatus according to claims 1, 2 or 3 in which said double beam means comprises an equalizer beam positioned to receive the input force from said force applicator means and a pair of oppositely extending scissor beams for transmitting displacement to actuate the at least one electrical switch.

5. Electrical switch apparatus according to claim 4 including a push rod supported from each scissor beam in a manner extending generally normal to the surface of the supporting scissor beam toward the actuator of said at least one electrical switch to operate said actuator when its supporting scissor beam incurs predetermined changes in displacement.

6. Electrical switch apparatus according to claim 5 in which said biasing means comprises a spring member associated with each of said scissor beams imposing an adjustable preset force opposing displacement of the associated scissor beam in a displacement direction responsive to increasing values of force applied by said force applicator means.

7. Electrical switch apparatus according to claim 6 in which the adjustable force imposed by said spring member corresponds to an operational set point for said at least one electrical switch.

8. Electrical switch apparatus according to claim 6 including means to presettably restrict the total displacement distance for each of said scissor beams.

9. Electrical switch apparatus according to claim 6 in which said equalizer beam extends in a generally subtending relation to said scissor beams and includes a plurality of arms at each end having an upward extension for engaging the underside of the scissor beam thereat.

10. Electrical switch apparatus according to claim 9 in which the upward extension of all of said plurality of arms upwardly terminate in a substantially common plane.

* * * * *